United States Patent [19]

Wankmuller et al.

[11] Patent Number: 4,862,568

[45] Date of Patent: Sep. 5, 1989

[54] APPARATUS TO DRILL AND TAP A HOLLOW UNDERWATER MEMBER

[75] Inventors: Richard N. Wankmuller, New Orleans; Dale D. Norman, Marrero, both of La.

[73] Assignee: Shell Offshore Inc., Houston, Tex.

[21] Appl. No.: 204,951

[22] Filed: Jun. 3, 1988

Related U.S. Application Data

[63] Continuation of Ser. No. 849,617, Apr. 9, 1986, abandoned.

[51] Int. Cl.[4] ..... B23B 45/14; B23G 1/24; E02D 5/60

[52] U.S. Cl. ..... 29/26 B; 405/211; 408/22; 408/137

[58] Field of Search ..... 408/22, 87, 92, 102, 408/103, 104, 137, 139 R, 140; 81/57.11; 29/26 B, 568; 405/195, 211

[56] References Cited

U.S. PATENT DOCUMENTS

| | | | |
|---|---|---|---|
| 666,146 | 1/1901 | Lanz | 52/731 |
| 855,907 | 6/1907 | Shaw | 408/92 X |
| 1,156,890 | 10/1915 | Crow | 138/97 |
| 1,590,186 | 6/1926 | Fanselow | 408/137 |
| 1,935,902 | 11/1933 | Brant | 138/97 |
| 2,151,594 | 3/1939 | Grantham | 10/140 |
| 2,653,451 | 9/1953 | McCullough | 405/195 |
| 3,202,732 | 8/1965 | Braun et al. | 264/36 X |
| 3,357,445 | 12/1967 | Daugherty | 408/137 |
| 3,505,825 | 4/1970 | Colby | 405/223 |
| 3,690,110 | 9/1972 | Wiswell | 405/216 |
| 4,060,953 | 12/1977 | Milne | 264/36 X |
| 4,093,393 | 6/1978 | Smith et al. | 408/137 |
| 4,098,088 | 7/1978 | Mason | 81/57.11 X |
| 4,248,648 | 2/1981 | Kopp | 264/36 X |
| 4,439,070 | 3/1984 | Dimmick | 405/216 |
| 4,692,064 | 9/1987 | Wankmuller | 405/211 |

FOREIGN PATENT DOCUMENTS

| | | | |
|---|---|---|---|
| 2278439 | 3/1976 | France | 408/22 |
| 14426 | 1/1984 | Japan | 10/140 |
| 31992 | 3/1921 | Norway | 405/222 |
| 1439214 | 5/1976 | United Kingdom | 405/216 |

*Primary Examiner*—Z. R. Bilinsky

[57] ABSTRACT

An apparatus of reinforcing a hollow underwater member of an offshore platform which includes removable power-actuated motors, retaining means for preventing rotational movement of the motors relative to the retaining means while permitting axial movement of the motors, a drill and tap operatively connected to and driven by the motors for forming at least one port through a side wall of the hollow underwater member, and means operatively engageable with the motors for controlling the axial movement of the drill and tap in at least one direction during a port-forming operation.

2 Claims, 6 Drawing Sheets

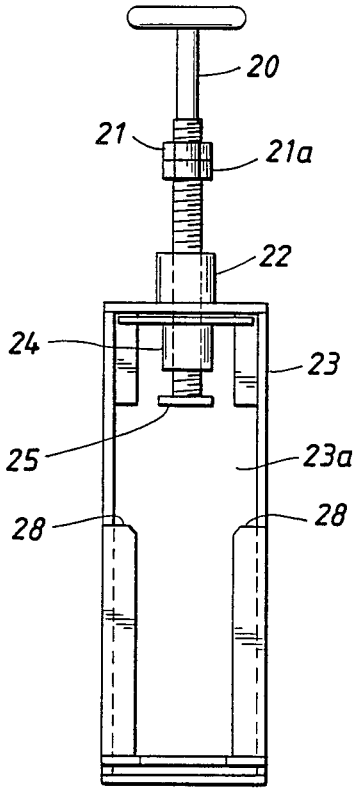
FIG. 1
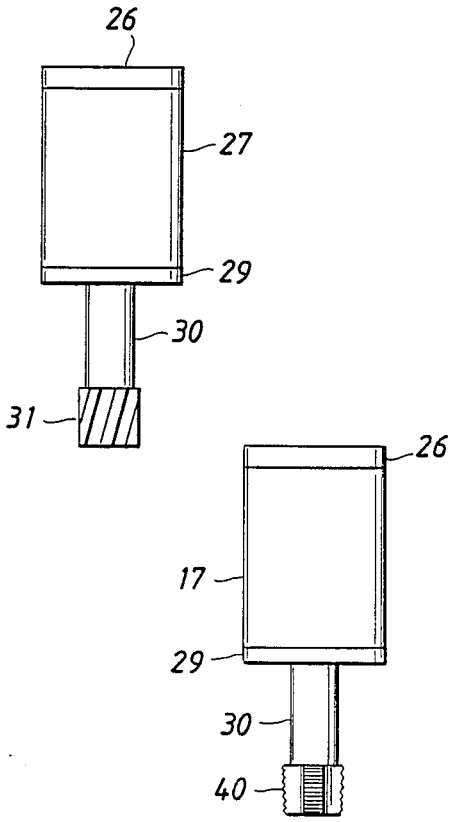
FIG. 2
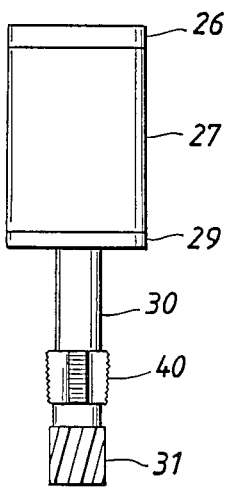

APPARATUS TO DRILL AND TAP A HOLLOW UNDERWATER MEMBER

This is a continuation of application Ser. No. 849,617, filed Apr. 9, 1986, now abandoned.

BACKGROUND OF THE INVENTION

This invention relates to an apparatus for strengthening a hollow underwater member, which has become weakened as a result of corrosion or other structural damage, such as members of an offshore platform.

Present day offshore platforms used in the oil and gas industry have legs and bracing members that require reinforcing as a result of becoming weakened due to corrosion or other structural damage. Generally, more than one apparatus is required to both drill and tap a member to be reinforced which makes it cumbersome for a diver handling the equipment underwater. Furthermore, realigning a second apparatus to tap a previously drilled hole is difficult to accomplish underwater.

Additionally, the devices for drilling and tapping the member must be designed so that the axial movement of such devices will not damage the piles inside the legs of a platform.

Furthermore, suitable equipment must be available for complete evacuation of free water at the upper end of non-vertical members to achieve complete grouting of the member.

It is the object of the present invention to provide an apparatus for reinforcing hollow underwater members.

Applicant is not aware of any prior art which, in his judgment as one skilled in this particular art, would anticipate or render obvious the present invention. However, for the purpose of fully developing the background of the invention, and establishing the state of requisite art, the following art is set forth: U.S. Pat. Nos. 666,146; 1,156,890; 1,935,902; 2,653,451; 3,202,732; 3,505,825; 3,690,110; 4,060,953; 4,248,648; 4,439,070; and British Pat. No. 1,439,214 and Norwegian Pat. No. 31,992.

SUMMARY OF THE INVENTION

The present invention is directed to an apparatus for reinforcing hollow underwater members such as legs and bracing of an offshore platform which are weakened as a result of corrosion or other structural damage. The apparatus preferably includes removable power-actuated motors, retaining means for preventing rotational movement of the motors relative to the retaining means while permitting axial movement of the motors, a drill and tap operatively connected to and driven by the motors for drilling and tapping at least one port through a side wall of the hollow underwater member, and means operatively engageable with the motors for controlling the axial movement of the cutting means in at least one direction during a port-forming operation.

The depth of cutting is controlled by a threaded handle and lock nut screw arrangement so as not to damage piles if the underwater member is a leg of a platform. Hollow members may be drilled and tapped in less than 10 minutes depending upon the wall thickness of the member.

The apparatus may be rigidly positioned on any hollow member having a diameter that exceeds 10 inches by means comprising a drilling guide and means for securing the drilling guide to the hollow member. The means for securing the drilling guide comprises a cable and tension device for securing the cable around the drilling guide positioned on the hollow member. Additionally, at least one guide positioned adjacent to the drilling guide and having an opening for a handle as another tension device for securing the cable may be provided.

After drilling and tapping the port of the hollow member, an air hose is connected to one of the formed ports of the member and pressured up to locate any leaks which may have been caused by corrosion or other structural damage. Any decrease in pressure signifies a hole or crack in the wall of the hollow member. After patching the member, it is then evacuated by pumping air into the formed ports until all water is displaced.

Next, grout is formed into the lower port of the member and through the member, and then out the upper port to a vessel on the water surface in order to check the grout composition.

One advantage of the present invention is the removeable motors which allow a diver, after drilling a port through the member to be reinforced, to remove the motors and its drill from the housing and exchange it with another motors having a tapping element on its shaft. The flexibility of employing exchangeable motors allows the diver to perform both drilling and tapping operations without having to assemble or interchange the drilling and tapping elements while underwater. Furthermore, since the retaining means for the motors is fixedly secured to the member, proper alignment of the tapping element with respect to the previously drilled hole is ensured.

Another advantage of the present invention is the means for removing water in the member so that unwanted particles and contaminated water in the grout are minimized. Also, complete evacuation of water in the member avoids incomplete reinforcement due to migration of free water at the upper end of the member to be reinforced.

A further advantage of the present invention is that the apparatus is provided with a means for controlling the cutting depth so as not to damage piles inside the legs of a platform.

A principal object of the present invention is to provide an apparatus for reinforcing hollow underwater members weakened as a result of corrosion or other structural damage.

The various features of novelty which characterize the invention are pointed out with particularity in the claims forming a part of this disclosure. For a better understanding of the invention, its operating advantages and specific object obtained by its uses, reference may be made to the accompanying drawings and descriptive matter in which there are illustrated preferred embodiments of the invention.

BRIEF DESCRIPTION OF THE DRAWINGS

FIG. 1 is a diagrammatic view of the removable power-actuated motors and drill and type operatively connected thereto and their relationship to the retaining means for preventing rotational movement relative to the retaining means while permitting axial movement of the motors.

FIG. 2 is a diagrammatic view of a drill combined with a tap for use with the motors of FIG. 1.

DESCRIPTION OF THE PREFERRED EMBODIMENT

Figure 4:
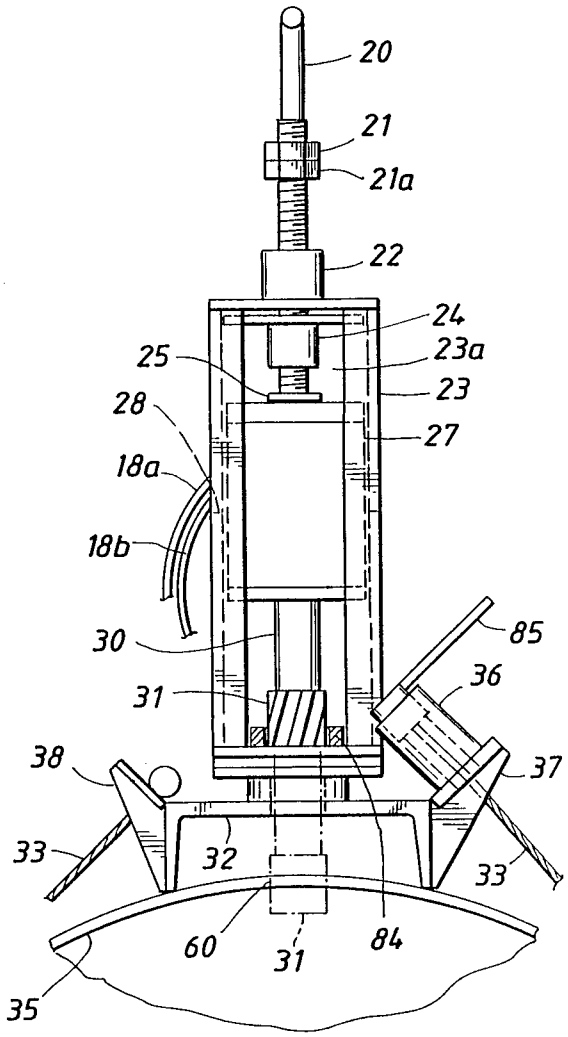
FIG. 4 is a diagrammatic view illustrating the means for controlling the axial movement of the drill and tap operatively engaged with the motors.

Referring to FIG. 1 of the drawings, a removable power-actuated motor 27 having a top plate 26 and a bottom plate 29 has a shaft 30 having a drill 31 at the end thereof. A cage or housing in which the motor 27 is slideably mounted forms retaining means 23 which prevents rotational movement of the motor 27 relative to the retaining means while permitting axial movement of the motor The retaining means 23 has means for freely exchanging the motor 27 and drill 31 for a second removable motor 17 and tap 40 such as an opening 23*a* in one wall thereof of a size sufficient to pass the motor means 27 and the drilling means 31 therethrough. The second removable motor 17 having a tapping means 40 is exchangeable with the first removable motor 27 and is alternatively installed in the retaining means 23 for tapping the wall of a hollow member to form a port therein. Hence, drilling and tapping operations may be performed using the same retaining means 23 without moving it from an anchored position.

Alternatively, the tapping means 40 may be mounted on the shaft 30 to follow the drill 31 in the arrangement shown in FIG. 2 if the hollow member to be reinforced does not contain a pile.

Means for controlling the axial movement of the drill and tap at least in one direction during the port forming operation may comprise a threaded handle 20 extending from and through the top of the retaining means 23, a threaded collar 22 positioned on top of the retaining means 23 and operatively engaged with the threaded handle 20. At least two locknuts 21 and 21*a* are operatively engaged with and selectively positioned on the threaded handle 20 for setting the cutting depth. A second threaded collar 24 operatively engaged wtih the threaded handle 20 and positioned below and adjacent to the roof of the retaining means 23 may be used to provide additional alignment of the axial movement of the motor 27. Additionally, a removable collar 84 may be positioned on the floor of the base of the retaining means 23 having an opening of sufficient size to pass the drill 31 therethrough to provide further alignment of the drill 31. Although the handle 20 of the present invention is turned by hand to advance it through collar 22, it is to be understood that a geared-down hydraulic motor could be used instead to rotate the handle 20.

The opening 23*a* for passing the motors therethrough can be through a side wall of the retaining means 23 as shown in FIG. 1 or through an opening in the end wall such as the top plate 26 of the retaining means 23 which may be removably secured, as by screw threads or clamps (not shown).

The walls of the retaining means 23 may be continuous or non-continuous. For example, angles 28 at each corner of the retaining means 23 can serve both to retain the motor 27, shown in FIG. 1 as a hydraulic motor having a rectangular shape, and to prevent rotational movement of the motor 27 relative to the retaining means. However, the retaining means 23 could be circular whereby a key carried by the hydraulic motor could engage a keyway carried by the retaining means 23.

Figure 3:
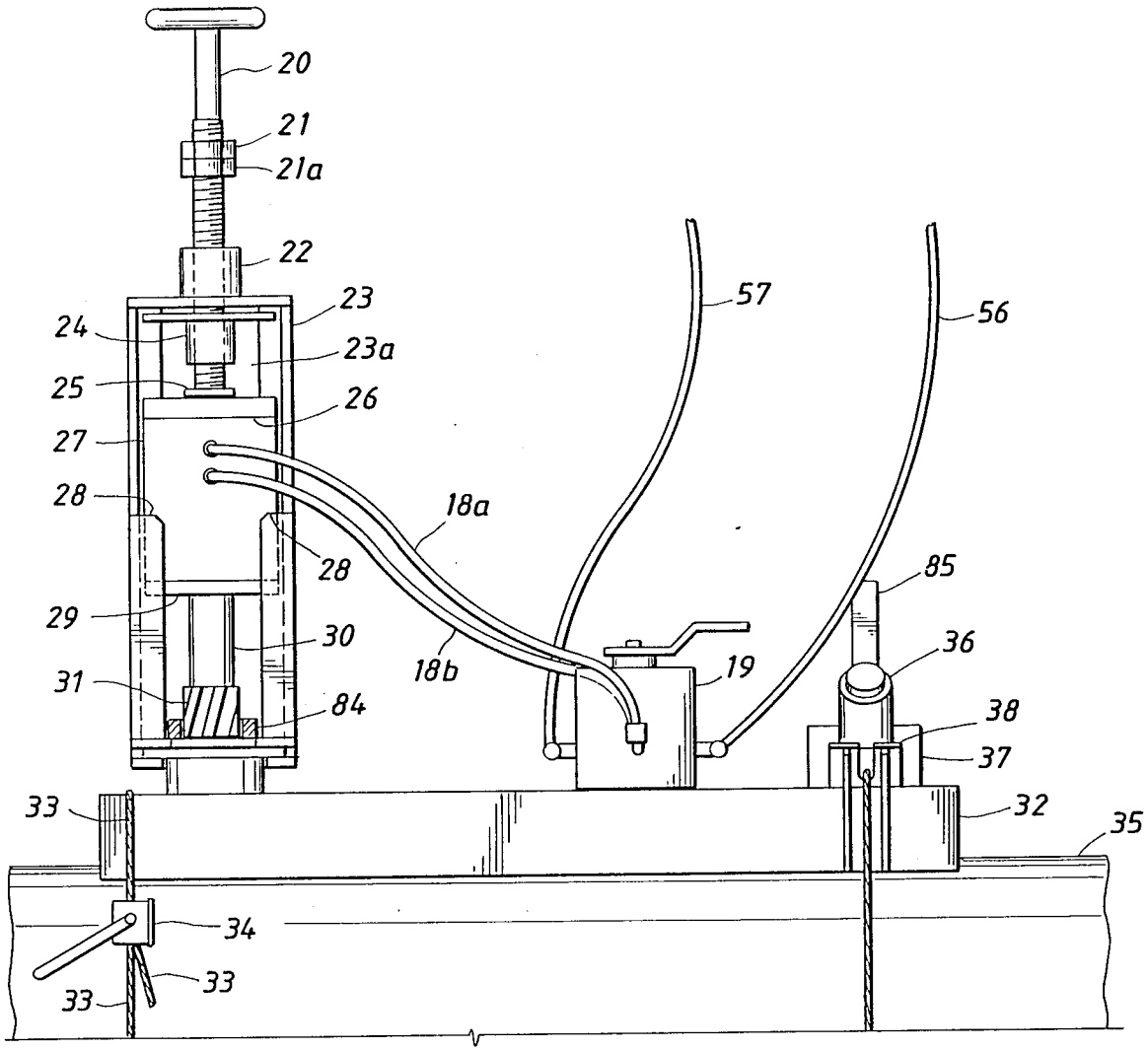
FIG. 3 is a diagrammatic view of the present apparatus fixedly positioned on the hollow underwater member.

FIG. 3 illustrates the apparatus secured to a hollow member 35 by a drilling guide 32, to which the retaining means 23 is fixedly secured, as by welding, and means for securing the drilling guide 32 to a hollow member 35. The means for securing the drilling guide 32 comprises a cable 33 or chain and a tension device 34 for securing the cable 33 around the drilling guide 32 positioned on the hollow member 35. If desired, means for guiding the cable 37 and 38 positioned on the drilling guide 32 may be provided such that each have an opening for retaining the cable 33. A collar 36, carried by a cable guiding 37, having an opening for a handle 85 as another tension device is positioned on substantially the opposite side of the drilling guide 32 relative to the members circumference and may also be used to facilitate the anchoring of the apparatus to the hollow member 35.

Proper anchorage of the apparatus to the member/leg is necessary to insure proper alignment of the retaining means 23 for forming the port in the member/leg and to prevent rotation of the retaining means 23 relative to the member/leg. The apparatus must be fixedly secured on the member/leg 35 so that the drilling and tapping assembly cannot be moved once it is in place, until the port-forming operation has been completed.

A power transmitting device in the form of hydraulic fluid pressure lines 56 and 57, extending from a vessel on the water surface to a bi-directional control valve assembly 19, is operatively connected to the motor 27 by the power transmitting lines 18*a* and 1 8*b* and extending outwardly through the wall opening 23*a* of the retaining means 23. The bi-directional control valve assembly 19, which is constructed in a manner well known to the art, provides selective forward or reverse rotation of the motor 27 to facilitate both forming the ports as well as reversing the drill and taps once the port has been formed.

The axial position of the drill 31 operatively connected to and driven by the motor 27 for forming at least one port 60 through the side wall of the hollow member 35 is shown in FIG. 4. The threaded handle 20, as previously described, is operatively engageable with the motor 27 to control the axial movement of the drill 31 at least in one direction during a port-forming operation.

With the drilling and tapping assembly secured in place on a member/leg, the threaded handle 20 is screwed down against the motor 27 until the drill 31 makes initial contact with the member/leg to be drilled. The power transmitting device is connected, in a manner previously described, prior to starting the hydraulic motor. A port is formed by tightening down on the threaded handle 20 to advance the operating motor 27 downwardly within its retainer 23 as the drill 31 cuts into the member/leg. An average drilling time is approximately 10 minutes depending upon the wall thickness of the member/leg.

Drilling is continued until further penetration of the member/leg 35 is blocked by the locknuts 21 and 21*a*. The setting of the valve 19 is then changed to reverse the flow of fluid through the motor 27 to facilitate backing out the cutter 31. Alternatively, backing out of the cutter 31 could be automated if the cutter 31 and threaded handle 20 were connected, by reversing the flow of fluid through the motor 27 to backout the cutter 31 while simultaneously backing off the threaded handle 20 to its original position. The drill 31 and first removable motor 27 are removed from the retaining means 23, with the threaded handle 20 back-off, by sliding the first removable motor 27 and associated drill 31 out of the opening 23*a* in the sidewall of the retaining means 23. The plug that has been cut from the member/leg 35 should be preferably kept inside the drill 31, such as by magnetizing the drill, or wedged within the wall thickness of the member so that it can be removed and not fall inside the member/leg. If the plug remains in the member/leg and it is desirable to remove it, it may be removed by wet welding a rod to it and pulling it back out of the port that has just been formed.

Next, the second removable motor 17 (FIG. 1), which is exchangeable with the first removable motor 27 and has a tap 40 for tapping the wall of the member/leg 35 forming the port, is installed in the retaining means 23. Again, the tap 40 is positioned in the drilled hole by lowering the motor assembly with the threaded handle 20 until the tap 40 makes light contact with the sidewall of the port 60 in a manner shown in FIG. 4. The set screws or locknuts 21 and 21*a* are adjusted for proper depth setting, if necessary. The power transmitting lines 18*a* and 18*b* (FIG. 3) are again connected and the motor 27 is started. The port is slowly tapped (FIG. 4) until the set screws or locknuts 21 and 21*a* prevent further penetration of the tap 40. The flow direction of the hydraulic supply is reversed using the bi-directional control valve assembly 19. The hydraulic motor is started to backout the tap 40. The second motor 17 and tap 40 are removed in the same manner as before. The apparatus is then moved to the next location on the member/leg to form another port as shown in the alternative configuration in FIG. 6.

Figure 5:
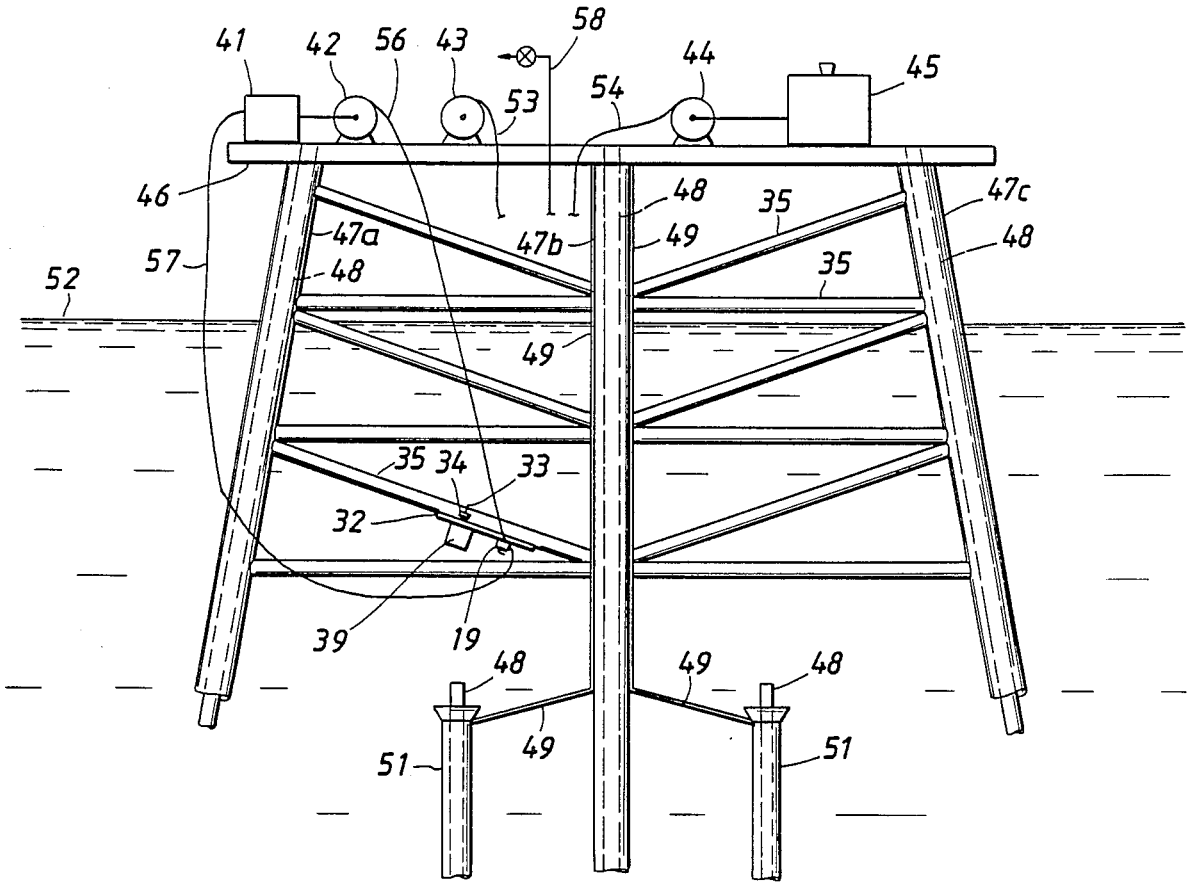
FIG. 5 is a diagrammatic view illustrating an arrangement of the underwater apparatus secured to a platform substructure together with its associated equipment positioned on the deck of an offshore platform.

A typical configuration of the apparatus and its peripheral equipment located on the deck of an offshore platform is shown in FIG. 5.

The apparatus 39 for drilling and tapping is provided with a power transmitting device 56 and 57 extending from the deck of a platform to a bi-directional control valve assembly 19 which is operatively connected to the motor of the apparatus 39 by power transmitting lines are previously shown in FIG. 3. FIG. 5 illustrates the power transmitting device as comprising a hydraulic fluid line 56 from a hydraulic pump 42 fed by a hydraulic reservoir 41, and a hydraulic fluid return line 57.

The hollow member 35 to be reinforced is inspected to determine if any leak holes exist which may have been caused by corrosion or other structural damage. This is done by using an air supply line 53, connected to a compressor 43, and to the formed port to observe escaping air bubbles along the surface of the member when air is injected into the member.

If no escaping air is observed from a member showing surface corrosion or other structural damage, a volume of grout is injected into the hollow member 35 to be reinforced via a cement slurry line 54 connected to the discharge of a pump 44 connected to a cement hopper 45. Preferably, a cement slurry return line 58 extending to the surface of the platform deck will be provided to insure adequate returns of cement, thus signifying proper reinforcement of the hollow member.

The air supply line 53 and the cement slurry line 54 may be manifolded in such a manner that either air or cement may be selectively pumped into the hollow member 35 that is being reinforced.

Figure 6:
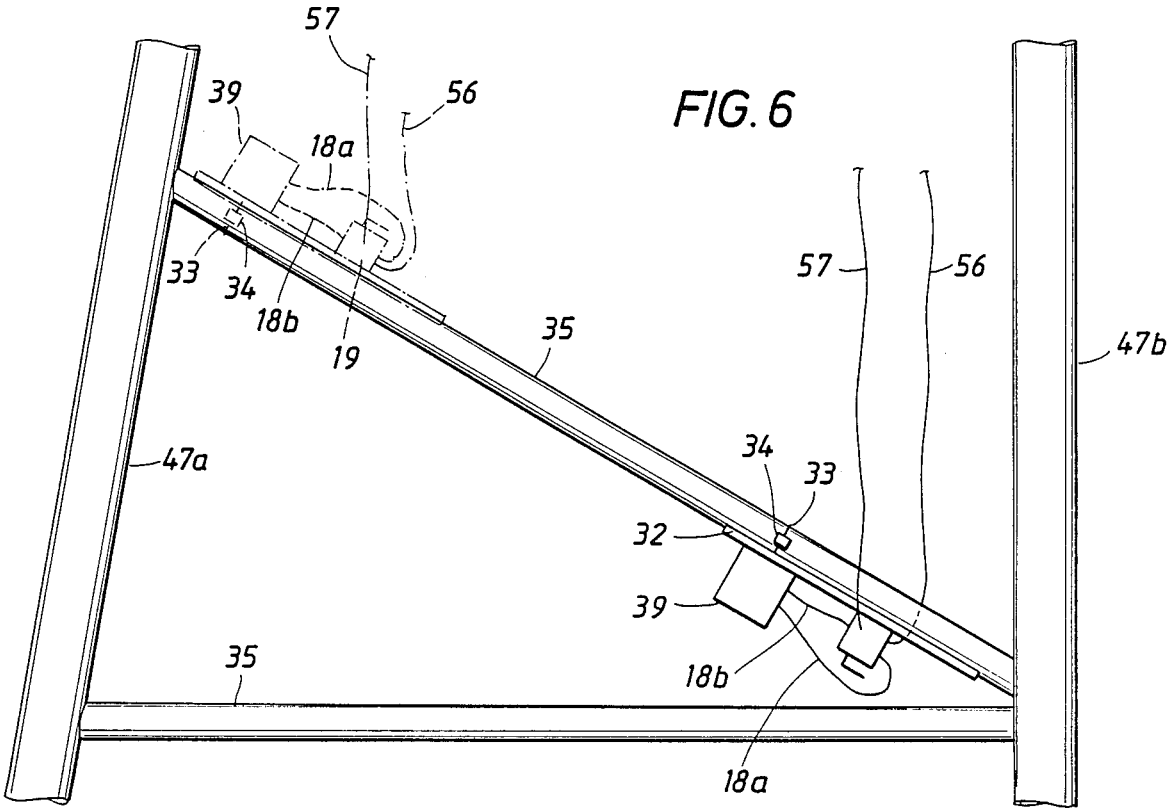
FIG. 6 is a diagrammatic view illustrating the apparatus anchored in alternative positions on a non-vertical hollow underwater member.

Referring to FIG. 6, the apparatus 39 for drilling and tapping is anchored to the hollow member 35 to be reinforced. Non-vertical members such as the one shown here are drilled and tapped on the upper side of the high end and the lower side of the low end about a foot away from the weld of the legs 47*a* and 47*b* and hence out of the high stress area.

Figure 7:
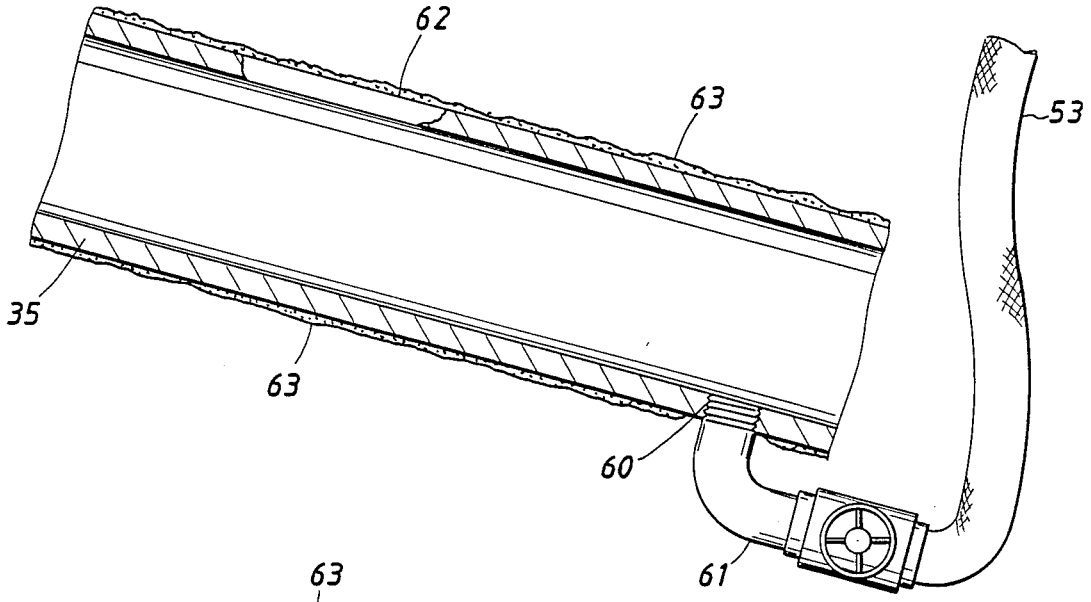
FIG. 7 is a cross-sectional view of a hole, caused by corrosion, which is covered with marine growth.

After the ports 60 (FIG. 7) have been formed, the member 35 is visually inspected for any possible holes, cracks, etc. that could cause air to escape. Additionally, the member is inspected by injecting air through the air line 53 and elbow 61 into the tapped port 60 of the member 35 as shown in FIG. 7. Air is pumped into the member 35 using a compressor 43 (FIG. 5) located on the deck of the offshore platform to an initial desired pressure. If the pressure stabilizes below the initial desired pressure, then the depletion of pressure signifies a hole or crack. The pressure reading upon stabilization indicates the approximate depth of the hole or crack in the member/leg. The member is then inspected for air bubbles. If bubbles are found, the holes or cracks are patched in a fluid-tight manner.

Figure 8:
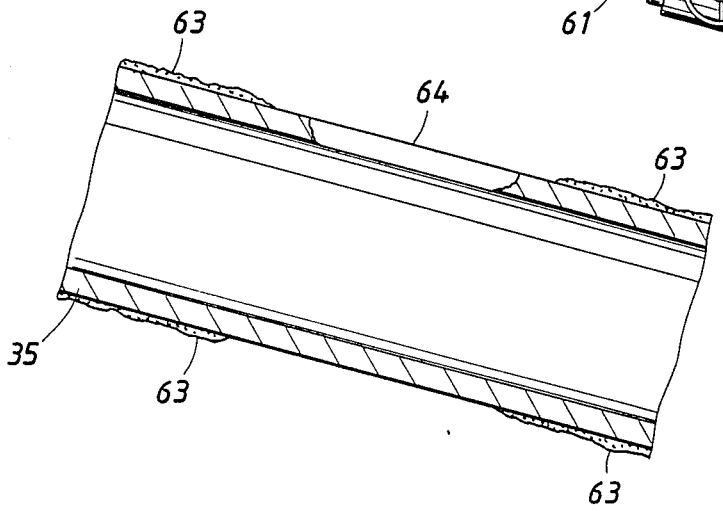
FIG. 8 is a cross-sectional view of a hole, caused by corrosion, which is cleaned of marine growth.

Any holes 62 which may have been caused by corrosion or other structural damage are typically covered with marine growth 63 as shown in FIG. 7. Prior to patching the holes, the areas around the holes of the member or leg to be patched should be cleaned, preferably by water blasting, so as to achieve the result of a cleaned hole as shown in FIG. 8.

Figure 9:
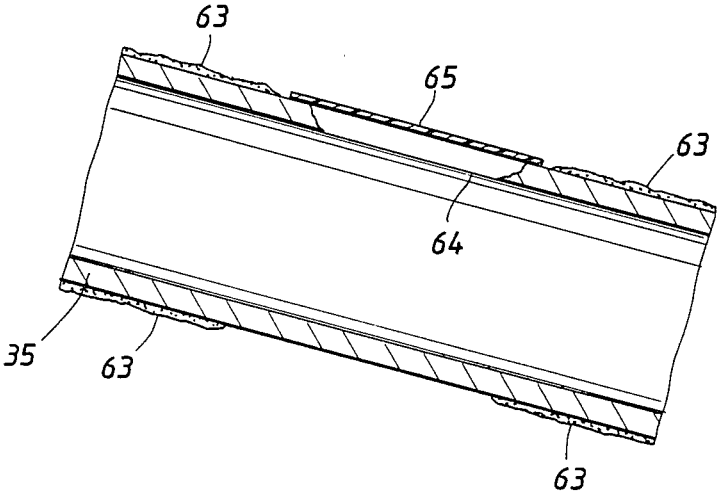
FIG. 9 is a cross-sectional view of a patched hole.

The cleaned hole 64 can be patched using a variety of types of patching materials, such as water settable plastic wrapping tape, steel plate with Neoprene backing 65, or wet welding as shown in FIG. 9. Since methods of closing holes or cracks in underwater members are well known to the art, they will not be further described here where any method may be employed in practicing this invention.

Figure 10:
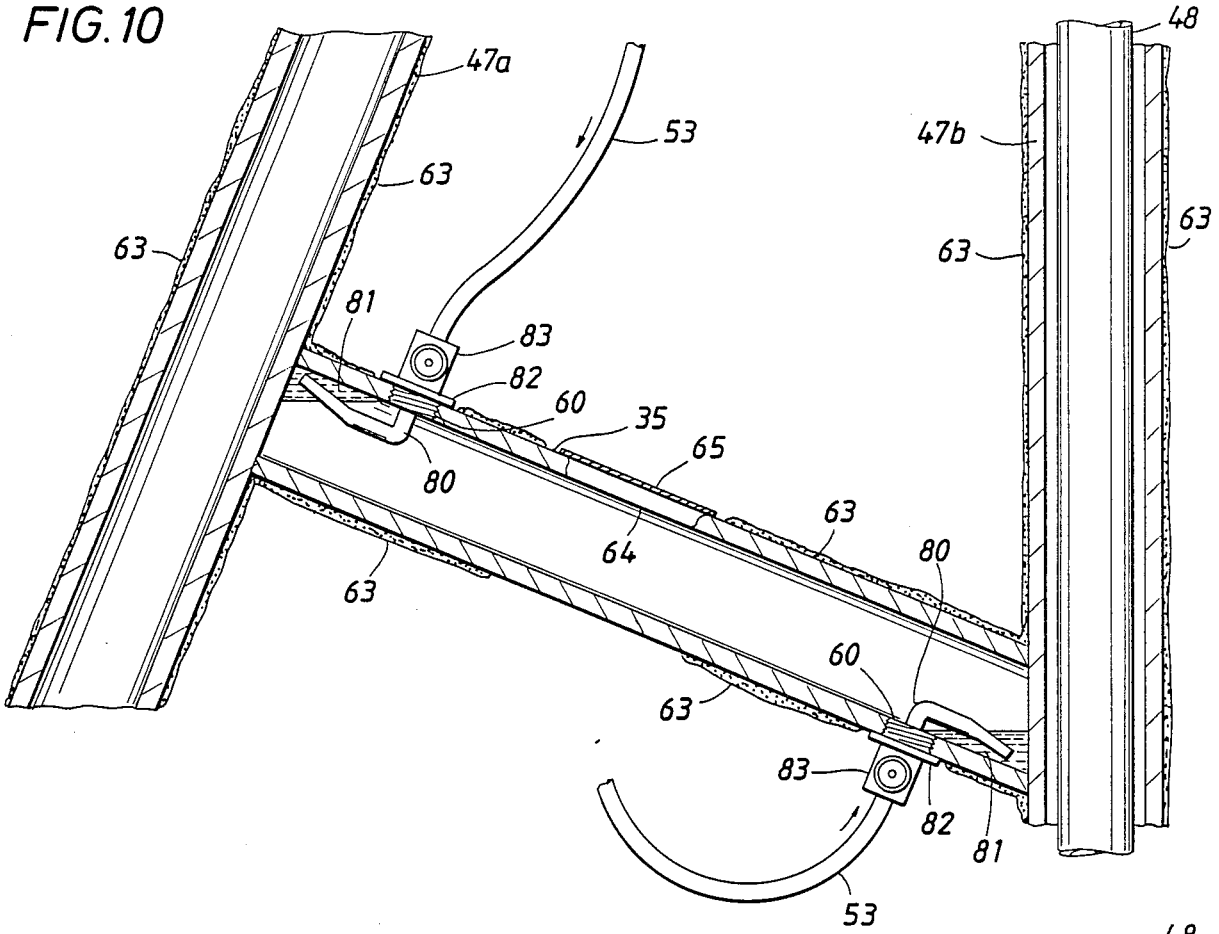
FIG. 10 is a cross-sectional view illustrating the use of a gooseneck for evacuating water in a non-vertical member.

Once the ports have been drilled and tapped and any holes and/or leaks patched, the water on the member is evacuated by forcing air through air lines 53 into the ports 60 using a gooseneck 80 and flange 82 arrangment shown in FIG. 10. The goosenecks 80 are inserted through the ports 60 so as to drive out water which would otherwise contaminate the grout. Use of the gooseneck is not required for vertical members.

Figure 11:
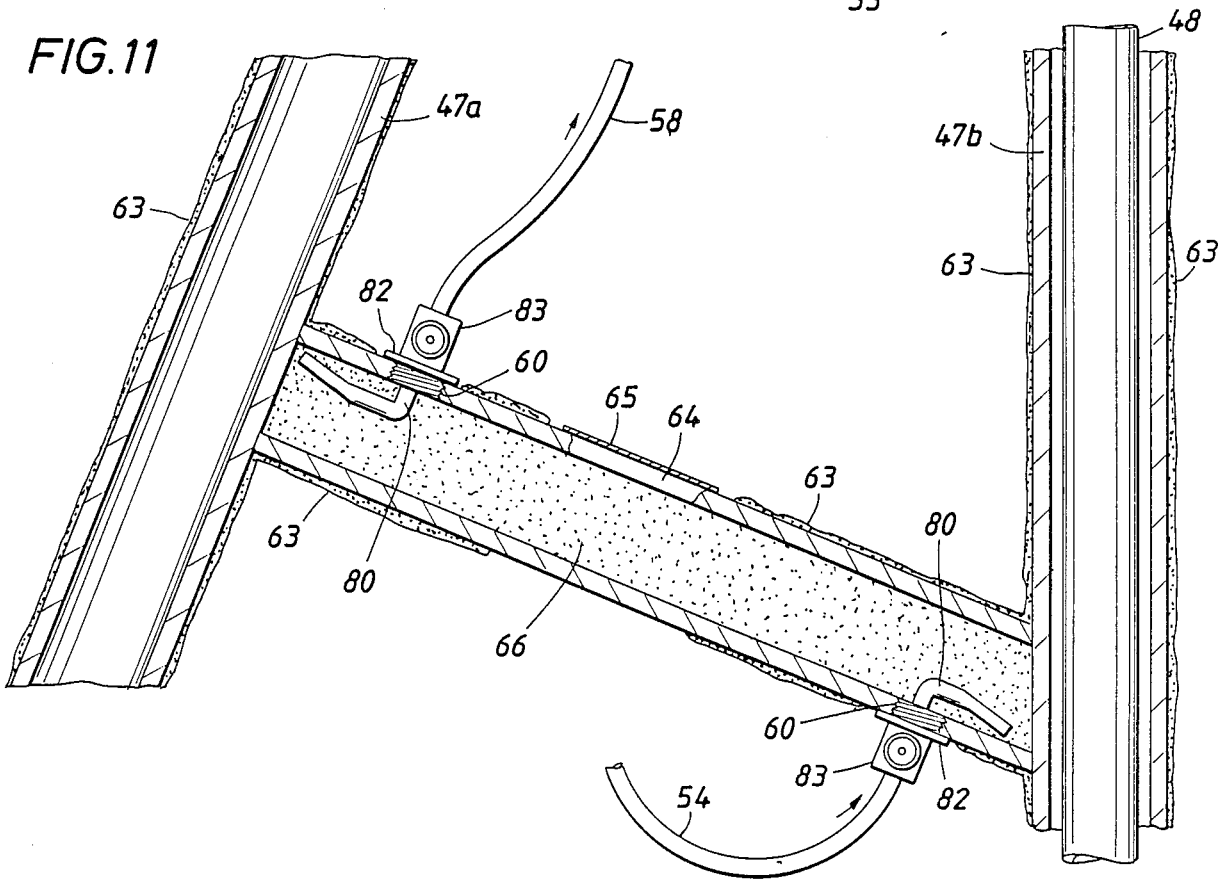
FIG. 11 is a cross-sectional view illustrating the grouting of a non-vertical hollow underwater member.

Once the water has been evacuated from the member 35, the air lines 53 are replaced by a cement slurry line 54 and a cement return line 58 as shown in FIG. 11. A volume of grout is injected into the patched member through one of the ports 60 to substantially fill it. The grout is circulated through the member 35 and back to a point above the water surface in the vicinity of the platform. Once the grouting operation is completed, the cement slurry line 54 and cement return line 58 are disconnected from the ports 60 of the member 35 and the valves 83 connected to these lines 54 and 58 are closed to let the grout set up.

Figure 12:
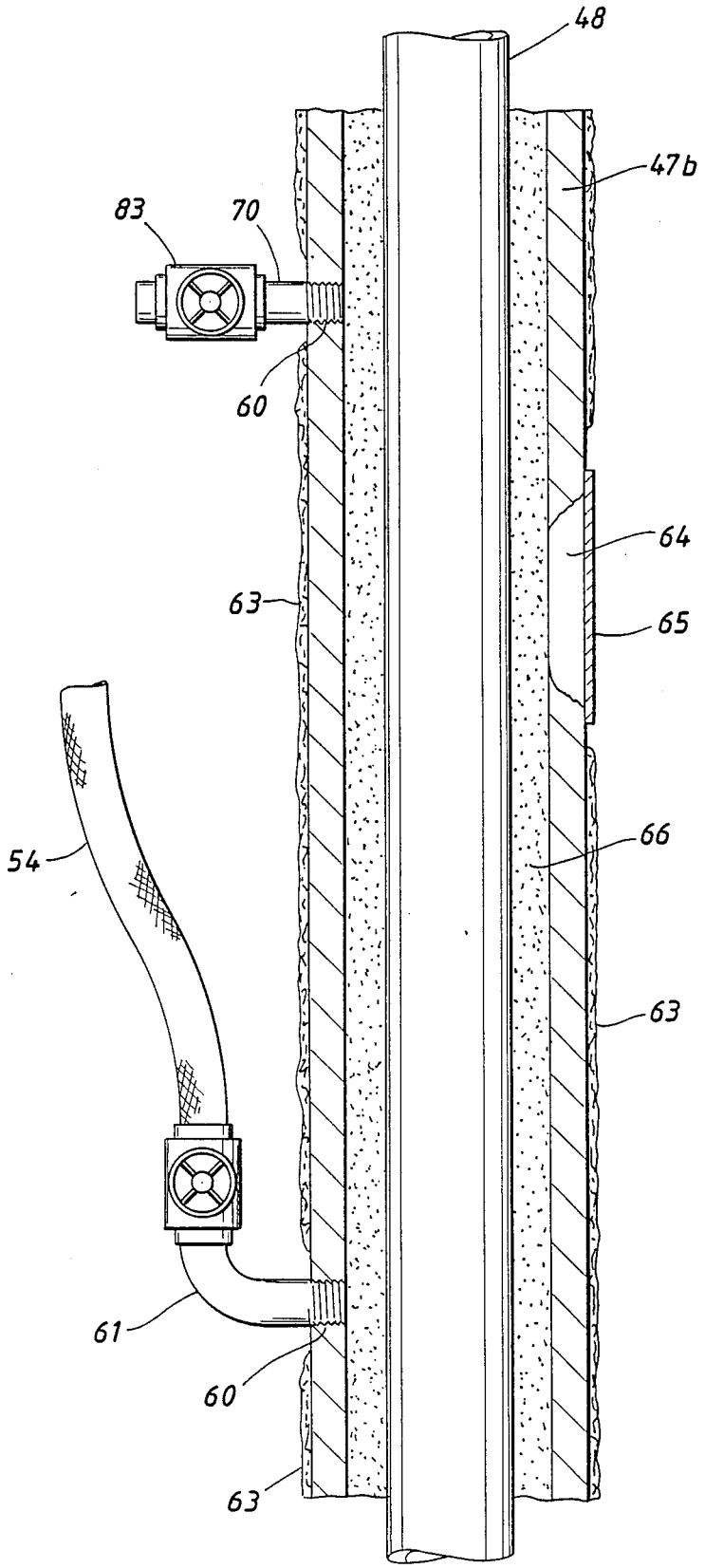
FIG. 12 is a cross-sectional view illustrating the grouting of a vertical hollow underwater member having a pile positioned concentrically therein.

Vertical members 47*b*, as shown in FIG. 12, may be drilled and tapped on the same side of the member and the above-described procedure may be used to reinforce the vertical members. As previously mentioned, caution must be exercised in drilling and tapping the ports 60 so as not to make contact with the pile 48. This restriction may be satisfied by selected placement of the locknuts 21 and 21*a* (FIG. 4) so as to control the axial movement of the threaded handle 20 of the apparatus.

What is claimed is:

1. An apparatus for forming a port in a hollow underwater member comprising:

two removable power-actuated motors adapted to be positioned in and removed from a retaining means, said motors comprising a first removable motor for drilling a port through a side wall of said member and a second removable motor exhangeable for said first removable motor for tapping the wall of said member forming said port;

retaining means in operative engagement with said motors whereby said motors are adapted to be positioned in and removed from said retaining means, said retaining means being operative to prevent rotational movement of said motors relative to said retaining means while permitting axial movement of said motors a drill operatively connected to and driven by said first motor for drilling at least one port through a side wall of said member;

a tap operatively connected to and driven by said second motor for tapping said at least one port;

said retaining means includes means for freely exchanging said first motor and drill for said second motor and tap without disassembling the apparatus;

means operatively engageable with said motors for controlling the axial movement of said drill and tap at least in one direction during a port-forming operation, said means for controlling including a threaded handle extending through the top of said retaining means, a threaded collar positioned at the top of said retaining means and operatively engaged with said threaded handle for controlling the axial position and movement of said handle, and at least two locknuts operatively engaged with said threaded handle outside said retaining means for setting the cutting depth;

means for fixedly securing said apparatus to an underwater member while said member is drilled and tapped, said means for fixedly securing including a drilling guide and means for securing said drilling guide to said member.

2. The apparatus of claim 1 including means for removing water from said hollow member to be filled with grout.

* * * * *